United States Patent [19]

Rombouts

[11] 4,448,233

[45] May 15, 1984

[54] PULLING DEVICE

[75] Inventor: Rombout M. Rombouts, BT Capelle A/D Yssel, Netherlands

[73] Assignee: Allpac Holding B.V., Raamsdonkveer, Netherlands

[21] Appl. No.: 440,270

[22] Filed: Nov. 9, 1982

[30] Foreign Application Priority Data

Feb. 5, 1982 [NL] Netherlands ..... 8200459

[51] Int. Cl.[3] ..... E06B 9/208

[52] U.S. Cl. ..... 160/319

[58] Field of Search ..... 160/319–322, 160/307, 308, 298; 16/205, 210, 215, DIG. 31; 24/115 R; 188/65.1

[56] References Cited

U.S. PATENT DOCUMENTS

| | | | |
|---|---|---|---|
| 54,435 | 5/1866 | Stevens et al. | 160/308 |
| 1,472,221 | 10/1923 | Jones . | |
| 2,308,291 | 1/1943 | Lorentzen | 24/132 |
| 2,731,111 | 1/1956 | Lorentzen | 188/64 |
| 3,424,224 | 1/1969 | Lowe | 160/308 |
| 3,854,517 | 12/1974 | Nakamura | 160/321 |
| 4,223,714 | 9/1980 | Weinreich et al. | 160/309 |
| 4,323,105 | 4/1982 | Berman | 160/309 |

FOREIGN PATENT DOCUMENTS

| | | | |
|---|---|---|---|
| 170922 | 4/1952 | Austria | 160/307 |
| 2208131 | 8/1973 | Fed. Rep. of Germany | 160/321 |
| 800441 | 5/1936 | France | 160/321 |
| 1042800 | 9/1966 | United Kingdom | 160/321 |

*Primary Examiner*—Peter M. Caun
*Assistant Examiner*—Cherney S. Lieberman
*Attorney, Agent, or Firm*—Wilkinson, Mawhinney & Theibault

[57] ABSTRACT

A pulling device for a roll shaft for roller blinds or screens comprises a cord pulley situated in a housing provided with a passage opening for cord parts. A clamp is disposed in a chamber in said housing and about the said cord parts, said clamp becoming operative when turning the cord pulley by the weight of the blind or screen.

3 Claims, 4 Drawing Figures

PULLING DEVICE

BACKGROUND OF THE INVENTION

1. Field of the Invention

The present invention relates to a pulling device for a material wound around a roll shaft, comprising a holder having disposed therein a rotatably supported cord pulley to be coupled to the roll shaft, around which puller a cord has been slung whose free parts pass through an opening in the holder.

2. Description of the Prior Art

A pulling device of this type has been used in the art and is described, for instance, in Dutch patent application No. 77,07922. Such pulling devices are used for roller blinds or screens and serve to so retain a roll shaft of the non-spring tensioned kind in a set position that due to the weight of a blind or screen, said blind or screen cannot be lowered in itself so that same is retained in any arbitrary position between the fully wound-up condition and the fully unwound condition.

SUMMARY OF THE INVENTION

It is a primary object of the present invention to provide a pulling device which can be made and assembled in a very simple manner from a minimum of component parts, the blocking effect being brought about automatically without needing to manipulate the cords in a particular direction other than that of pulling.

This object is attained according to the invention with a pulling device of the type described hereinbefore comprising a clamp situated in a space between the boundary of the opening in the holder and the cord pulley, said space having been adapted to accommodate in a movable relation said clamp which is disposed about the two parts of the cord, the cord parts being capable of sliding through an opening in the clamp adapted thereto. This has the advantage that it is always possible to pull one of the cord parts for winding up or unwinding a blind or screen without having to release first pawl means. If, on the other hand, for instance under the influence of the weight of a screen, a force or pull is being exerted upon the cord pulley, the clamp immediately blocks a rotational movement of the pulley.

In a practical embodiment according to the invention, the pulling device is so embodied that the clamp comprises parts laterally projecting from the cords and which, on the one hand, are capable of engaging the boundary of the opening and, on the other hand, of cooperating with the cord on the cord pulley in accordance with the loads being exerted upon the cord parts. If, in such a case, a cord hanging down from the pulling device is being pulled, the clamp will not become operative. If, on the contrary, due to a force or pull being exerted upon the cord pulley, the part running from the clamp to the cord pulley is being pulled, there occurs a tilting or lateral displacement of the clamp, thus causing the other part to be pressed against the cord pulley, preventing the pulley from being rotated further.

To increase the effect of the clamp the latter is provided with shoulders on the laterally projecting parts on the side facing the cord pulley.

It is an additional advantage of the present invention that the cord is properly retained on the cord pulley because, in a practical embodiment, the cord is slung around almost the entire circumference of the cord pulley while the clamp is so designed that it forms a bending member for the cord parts, said parts passing side by side through the opening in the holder.

According to the invention the pulling device can be constructed in a very simple manner and in a flattened shape, as the holder for the cord pulley is a housing, a small side wall of which being provided with an opening for passage of the cord parts, said housing comprising a chamber for accommodating a clamp. The housing may then be a shell open on one side covered with a cap that may have an identical shape. The additional great advantage of this feature is that the pulling device itself may serve as a mounting support, when fitting for instance a blind or screen into the bay of a sash.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF A PREFERRED EMBODIMENT

Figure 1:
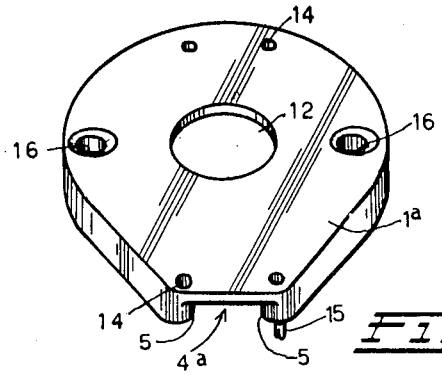
FIG. 1 is a perspective view of the pulling device according to the invention, a part having been removed therefrom.

Referring now to FIG. 1 the pulling device according to the invention comprises a holder 1 or shell-shaped housing wherein a rotataby supported cord pulley 2 is disposed to be coupled to a roll shaft of, for instance, a roller blind or screen. Slung around said cord pulley there is a cord 3 whose free parts 3*a* and 3*b* pass to the outside through the opening 4. Between the boundary 5 of the opening 4 in the holder 1 and the cord pulley 2, there is provided a space 6 for accommodating a clamp 7 in a movable relation, said clamp 7 being disposed around both parts 3*a* and 3*b* of a cord 3. Said parts 3*a* and 3*b* are slideable through an opening 8 provided to this end in the clamp 7.

Figure 3:
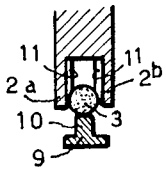
FIG. 3 is a sectional view taken along line III—III in FIG. 2.

The clamp 7 comprises parts 9 projecting laterally from the cord 3, said parts being capable of co-operation, on the one hand, with the boundary 5 of the opening 4 and, on the other hand, with cord 3 on cord pulley 2 in dependance of the loads being exerted upon the cord parts 3*a* and 3*b*. Furthermore, the clamp 7 is provided with shoulders 10 located on the laterally projecting parts 9 on the side facing the cord pulley 2. The shoulders 10 have a thickness smaller than the distance between the flanges 2*a* and 2*b* of the cord pulley 2. On the surfaces of the flanges 2*a* and 2*b* facing each other at a certain distance from their circumference, the cord pulley is provided with ribs 11 or ridges, upon which the cord portion put around the cord pulley can rest. In addition, the height of the shoulders 10 on the clamp 7 is such that they afford pressing the cord 3 between said ridges or ribs 11 (FIG. 3).

Figure 2:
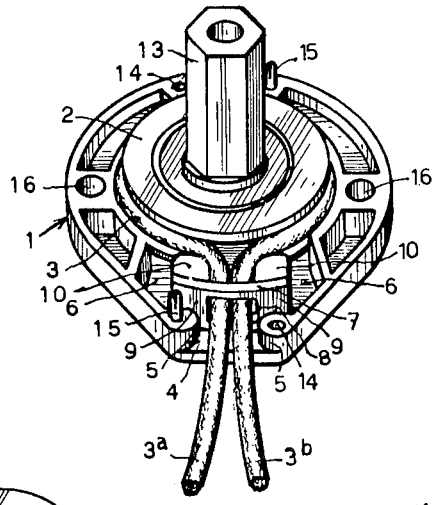
FIG. 2 is a side view of a cord pulley with a part cooperating therewith.
Figure 2:
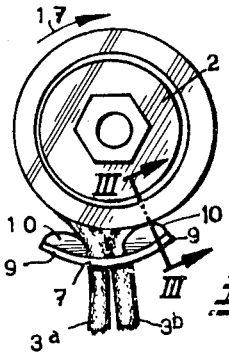

Additionally referring to FIG. 2, the cord 3 is slung around almost the entire circumference of the cord pulley 2, the clamp being so designed as to form a bending member for the cord parts 3*a* and 3*b*, said parts passing side by side through the opening 4 in the holder 1. In this case, the parts 3*a* and 3*b* of cord 3 are led through the mutual opening 8 in the clamp 7.

Reverting now to FIG. 1 it is summarized that the holder 1 for the cord pulley 2 is a housing consisting of a shell open on one side, a small side wall of which being provided with a passage opening 4 for the parts 3*a* and 3*b* of cord 3 and for a shaft stub of the cord pulley 2, said opening being formed by a peripheral cutout in said shell, said housing comprising a chamber or space 6 for accommodating the clamp 7, and a space accommodation for the cord pulley 2.

Figure 4:
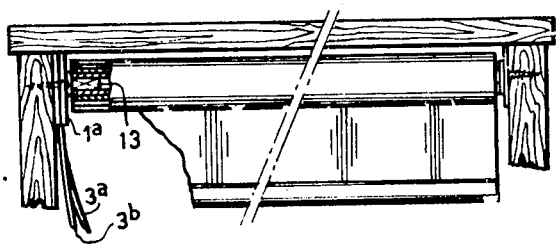
FIG. 4 is a front view of a roller blind on a reduced scale partly in section at one end fastened in a window sash by means of the pulling device according to the invention.

The one-side open shell is covered with a cap 1*a* comprising a passage opening 12 for a shaft stub, said shell and cap having identical shapes. From this it follows that both shell and cap consist as it were of two housing half-members. Preferably, one of the shaft stubs is shorter than the wall thickness of the housing, whereas the other shaft stub of the cord pulley 2 has a greater length and preferably a hexagonal or tetragonal shape. The latter shaft stub being referenced 13, serves to be coupled to a roll shaft of, for instance, a roller blind or screen (FIG. 4). This roll shaft is not further described because roll shafts for blinds or screens are known in this field of the art, and do not form part of the present invention. The two identical housing parts 1 and 1*a* have a certain asymmetry in respect to their line of symmetry, from which it results that these parts may alternately be provided with holes 14 or snap-taps 15. Thus, after having assembled the pulling device, the two parts can easily be pressed together so as to form a solid entity. In addition, there are provided holes 16 affording the passage of fastening screws in case that the pulling device is to be mounted into the bay of a sash or to a separate support (FIG. 4).

The operation of the device according to the invention is as follows.

When one of the parts 3*a* or 3*b* is being pulled, for instance when pulling up or lowering a roller blind or roller screen, the clamp evenly abuts with both its laterally projecting parts 9, the boundary 5 of the opening 4 in the chamber 6 of the housing 1 and cap 1*a*. This allows a small lateral displacement. However, when the cord pulley is rotated, e.g. due to the weight of the roller blind or screen, in the direction of the arrow 17 (FIG. 2), cord part 3*a* is stretched between the clamp 7 and cord pulley 2, thereby causing a substantial lateral displacement of said clamp.

Since, as a result of an introductory rotational movement, cord part 3*b* is somewhat slackened, said lateral displacement is enlarged, and the clamp with a shoulder 10 tailing said displacement will move in the direction of the cord pulley, thus pressing said shoulder tightly against said cord pulley. If very strong forces are exerted upon the cord pulley, cord 3 may possibly be pressed between the tops of the ribs 11. A further rotation of the cord pulley 2 is thus rendered impossible. The great advantage of the surprisingly simple clamp 7, is in addition that by using this clamp, both a blocking in the one direction of rotation of the cord pulley 2 and a blocking in the opposite direction of rotation of said pulley are rendered possible.

What is claimed is:

1. A pulling device for a material wound around a roll shaft comprising in combination:

(a) a cord pulley having a projecting hub, (b) a housing for rotatably supporting said cord pulley and being provided with a lateral opening for passing the projecting hub of said pulley adaped to be connected to a roll shaft and provided with a cord opening for passing the free ends of a cord wound about said cord pulley, (c) clamp means having an opening for passing said cord ends situated within said housing at one side of the cord pulley periphery between said pulley and the boundary of said cord opening in said housing, (d) said housing defining a chamber between the boundary of said cord opening and said cord pulley permitting of a tilting motion of said clamp, (e) end portions on said clamp projecting toward said pulley at both sides of its opening for said cord adapted to abut against the housing at said boundary of said cord opening in the housing permitting a rotation of said cord pulley when pulling one of said cord ends from outside of the housing and permitting a tilting of said clamp when a rotational force is exerted on said hub of said cord pulley.

2. A pulling device according to claim 1, wherein said projections on the end parts of said clamp are positioned to press the cord in a cord groove of said cord pulley.

3. A pulling device according to claim 2, wherein said housing is composed of two shell-shaped identical halves being provided with an opening for said hub and provided with a circumferential cut out for forming said cord opening.

* * * * *